United States Patent [19]

Hedgecock et al.

[11] 3,995,691

[45] Dec. 7, 1976

[54] TOOL FOR CONTROLLING FLUID FLOW AT REMOTE LOCATIONS

[76] Inventors: Floyd R. Hedgecock, 800 E. Polk St.; Andrew J. Trent, 232 Washington St., both of, Coalinga, Calif. 93210

[22] Filed: Sept. 8, 1975

[21] Appl. No.: 611,063

[52] U.S. Cl. ..... 166/105; 166/334

[51] Int. Cl.[2] ..... E21B 43/00

[58] Field of Search ..... 166/105, 112, 224 R, 166/226; 417/434

[56] References Cited

UNITED STATES PATENTS

| | | | |
|---|---|---|---|
| 1,517,611 | 12/1924 | Boynton | 166/226 |
| 3,216,452 | 11/1965 | Williams | 166/226 |
| 3,497,001 | 2/1970 | Brown | 166/226 |
| 3,497,009 | 2/1970 | Harrington | 166/226 |
| 3,610,337 | 10/1971 | Lewis | 166/226 |

*Primary Examiner*—James A. Leppink
*Attorney, Agent, or Firm*—Huebner & Worrel

[57] ABSTRACT

A tool having a housing adapted for connection to a conduit at a remote location and having a first passage extending therethrough and communicating with the exterior of the housing through a discharge opening and a second passage extending through the housing circumventing a portion of the first passage in a by-pass position, and a valve mechanism adapted for connection to the conduit and received within the first passage for movement to and from the by-pass position whereby fluids flow through said second passage and from the discharge opening in the by-pass position and through the conduit through the tool when in a position retracted from the by-pass position.

16 Claims, 5 Drawing Figures

TOOL FOR CONTROLLING FLUID FLOW AT REMOTE LOCATIONS

BACKGROUND OF THE INVENTION

1. Field Of The Invention

The present invention relates to a tool for controlling fluid flow at remote locations and more particularly to such a tool which has particular utility in wells quickly and easily to permit the discharge of hydrostatic pressure from well tubing or conduit within the well prior to and during removal of portions of the well conduit from the well so as to facilitate repositioning of the conduit and associated equipment within the well as well as to avoid the necessity for discharging the well fluids creating the hydrostatic pressure at the earth's surface which constitute both ecological and fire hazards and otherwise interfere with well operation. It will be recognized that, while the tool of the present invention was developed for and has particular utility for usage in wells of a variety of types, the tool also has utility of marked significance in many other areas of application where it is necessary to control the flow of fluids through and periodically divert the passage of fluids from a conduit at a remote location.

2. Description Of The Prior Art

It is necessary in well operation and particularly oil well operation to remove the fluid conductive well conduit from the well at periodic intervals during normal use of the well for repositioning of a submersible pump located at depth in the well, for servicing of the tubing and well casing, for servicing or replacement of the pump, for treatment of the formation laterally of the well casing and the like. Of course, normal operation of the well fills the conduit above the pump with fluid extending to the earth's surface. If the conduit is to be removed for any one of the various reasons, the conduit must be raised and disassembled section by section at the earth's surface. Unless preventive measures are taken, the fluid within those sections is discharged over the earth's surface at the well site as this process is performed. Such discharge of fluids at the surface is a serious impediment to operation of the well particularly where the fluid is oil which constitutes both an ecological and a fire hazard and interferes with continued operation of the well unless cleaned up after the process is completed.

Certain prior art devices have been developed which permit, with less than satisfactory degrees of success, discharge of this hydrostatic pressure from the well conduit during removal from the well thereby allowing such fluids to be discharged into the well from the conduit rather than being dumped at the earth's surface. However, such devices are legion in the relative complexity and delicateness of their structures. Such prior art devices commonly require that the conduit be secured on the interior of the well casing in order for them to operate. Similarly, these prior art devices typically require the replacement of seals each time the device is used thereby requiring the entire conduit string to be withdrawn from the well after such use even where this is not otherwise necessary. Furthermore, such devices have been found to be inoperable when subjected to high temperatures such as are experienced in steam injection wells. Consequently, such prior art devices have not been widely used in the industry. Furthermore, conventional manual procedures requiring swabbing of the interior of each section of conduit as it is withdrawn from the well are extremely burdensome and expensive.

Therefore, it has long been known that it would be desirable to have a tool for controlling fluid flow at remote locations which permits the controlled discharge of hydrostatic pressure from well conduit, as well as conduit employed in other areas, whereby well fluids can be discharged into the well from the conduit, which does not interfere with the normal operation of the conduit, pump and associated well equipment and which can be used repeatedly for its designated purpose without requiring removal from the well for servicing even when subjected to high temperatures.

SUMMARY OF THE INVENTION

Therefore, it is an object of the present invention to provide an improved tool for controlling fluid flow at remote locations.

Another object is to provide such a tool which has useful application to a wide variety of environments wherein it is necessary to control and vary fluid flow upon command at remote locations.

Another object is to provide such a tool which is particularly well suited for use in wells of all types to permit the selective discharge of hydrostatic pressure from well conduit so as to avoid the necessity of discharging such fluids at the earth's surface.

Another object is to provide such a tool which can be operated from the earth's surface without requiring the device to be affixed to the well casing for operation.

Another object is to provide such a tool which can be operated with a facility not heretofore achieved in prior art devices intended for the purpose.

Another object is to provide such a tool which can be operated repeatedly during a prolonged operational life without requiring frequent withdrawal from the well for servicing.

Another object is to provide such a tool which can be operated in steam injection oil wells and otherwise subjected to conditions of high temperature without malfunction or structural damage.

Another object is to provide such a tool which has two operable configurations, one of which allows normal operation of the pump and well conduit without interference from the tool and the second of which allows fluid to be discharged therethrough from the conduit without interfering with the pump.

Another object is to provide such a tool which possesses components which can be employed to assist in freeing a pump which has become lodged in the casing.

A further object is to provide such a tool which does not require sophisticated manipulations involving the well conduit and well casing to operate the tool.

Further objects and advantages are to provide improved elements and arrangements thereof in an apparatus for the purposes described which is dependable, economical, durable and fully effective in accomplishing its intended purposes.

DESCRIPTION OF THE PREFERRED EMBODIMENT

Figure 1:
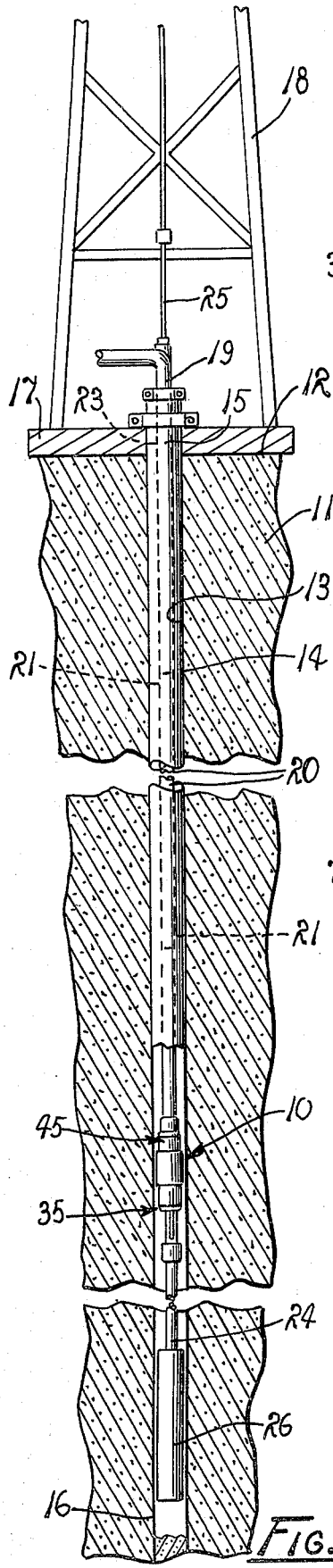
FIG. 1 is a fragmentary vertical section of a well within which the tool of the present invention is mounted, the well being representative of those environments in which the tool can effectively be employed.

Referring more particularly to the drawing, the valve assembly or tool of the present invention is generally indicated by the numeral 10. The tool is shown in FIG. 1, in a typical operative environment wherein the earth is indicated at 11 and the earth's surface at 12. A well or borehole 13 is formed in the earth and a cylindrical well casing 14, having an upper end portion 15 and a lower end portion 16, is inserted in the borehole in the conventional manner. A well platform 17 is positioned on the earth's surface and a well rig 18 is mounted on the platform. A well head 19 is mounted on the platform and connected to fluid handling equipment, not shown. A well tubing or conduit 20, composed of a plurality of conduit sections 21, is secured on the well head in the conventional manner and extends therefrom down the interior of the casing within the borehole to the point in the borehole from which the fluid to be recovered, such as oil, water, or the like, is to be pumped. The conduit has a substantially cylindrical interior surface 22, an upper end portion 23 and a lower end portion 24.

Figure 2:
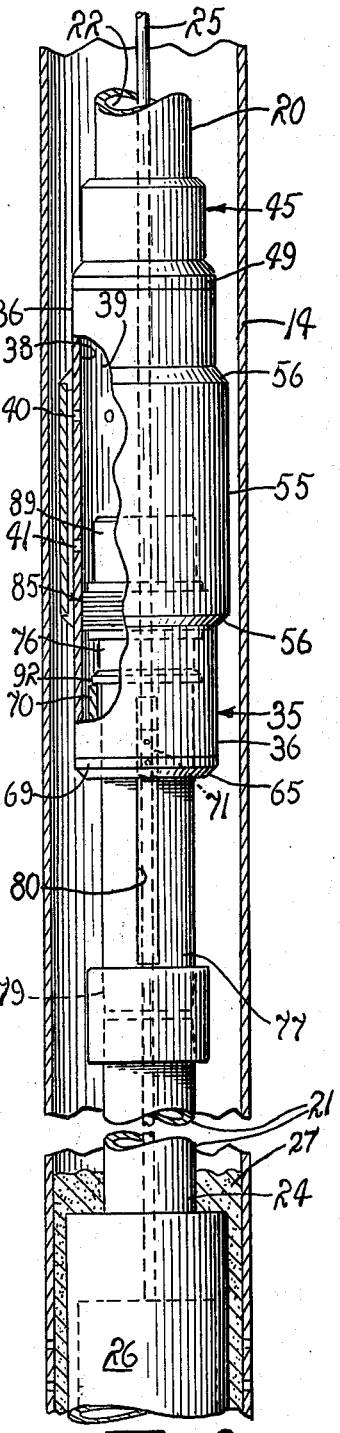
FIG. 2 is a somewhat enlarged fragmentary vertical section of the well showing the tool mounted therein.
Figure 5:
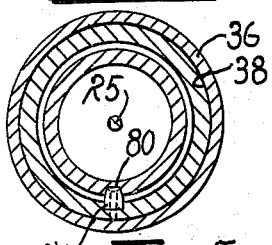
FIG. 5 is a transverse section taken from a position indicated by line 5—5 in FIG. 3.

The well rig 18 mounts a push rod 25 extending in the conventional manner through the well head 19 and through the interior of the conduit 20 into the well. The push rod is adapted to be reciprocated by equipment, not shown, associated with the well rig. A submersible fluid pump 26 is borne by the lower end portion 24 of the conduit. The push rod is operably connected to the pump and is adapted to operate the pump upon reciprocation thereof to pump fluid up the interior of the conduit to the well head for subsequent handling. As shown in FIG. 2, the pump may, by design or by unintended flow from the borehole through perforations, not shown, in the casing, be encased in sand or soil 27 within the casing.

Figure 3:
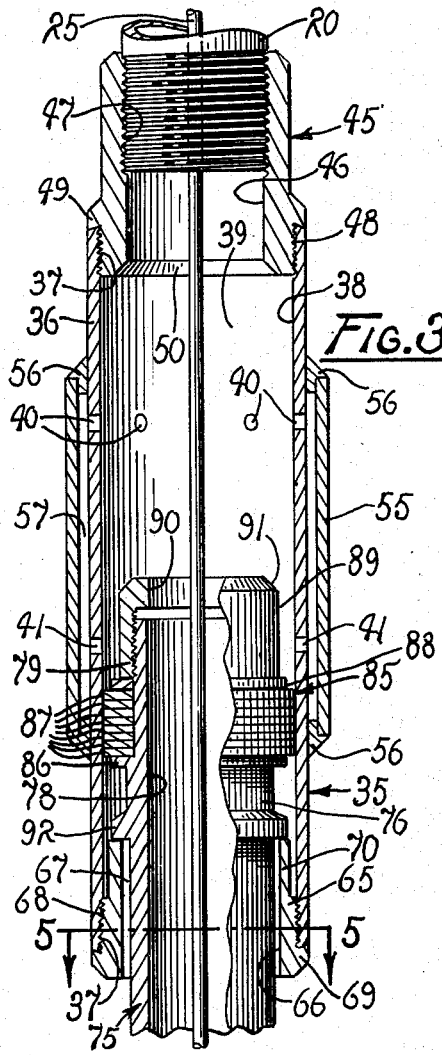
FIG. 3 is a somewhat further enlarged fragmentary vertical section of the tool.
Figure 4:
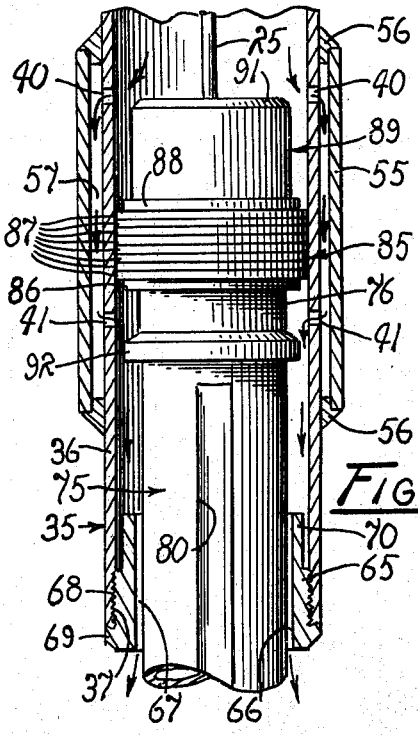
FIG. 4 is a fragmentary vertical section of the tool similar to FIG. 3 but showing the tool in a second operative configuration.

The tool 10 of the present invention has a first component or housing 35 best shown in FIGS. 2 and 3. The housing has a cylinder 36 having opposite internally screw-threaded end portions 37 and a substantially cylindrical internal surface 38. The internal surface 38 encloses and thereby defines a first passage or chamber 39. A plurality of first ports 40 and a plurality of second ports 41 are provided in the cylinder extending therethrough to communicate with the passage 39 thereof. The first ports 40 are spaced longitudinally on the cylinder from the second ports 41 such as shown in FIGS. 3 and 4. The specific number and size of the first and second ports most appropriate for the tool are dependent upon the volume and viscosity of the fluid to be handled by the tool as well as upon the requirements of the specific operation in which the tool is to be employed.

A first coupling 45 is mounted on the opposite end portion 37 of the cylinder 36 above the ports 40 and 41 as viewed in FIG. 3. The first coupling has an internal passage 46 extending axially therethrough. The first coupling has an internally screw-threaded end portion 47 and an opposite externally screw-threaded end portion 48. A flange 49 is radially extended from the first coupling in juxtaposition to the externally screw-threaded end portion 48. The coupling is mounted on the opposite end portion of the cylinder with the externally screw-threaded end portion screw-threadably secured in the end portion 37 of the cylinder as shown in FIG. 3 in abutted engagement with the flange 49. The coupling has a beveled shoulder 50 internally of the end portion 48 circumscribing the internal passage 46. The internal passage is adapted to interconnect in fluid transferring relation the interior of the conduit 20 and the chamber 39 of the housing 35 as will hereinafter be described.

The housing has an enclosure 55 fastened on the exterior of the cylinder 36 of the first component 35 extending in circumscribing relation about the cylinder and enclosing the first and second ports 40 and 41. the enclosure engages the cylinder at oppositely extending edges 56 in fluid-tight relation. The enclosure with the cylinder thus forms an annular second passage 57 therebetween interconnecting the first and second ports in fluid transferring relation.

The second coupling 65 is affixed on the end portion 37 of the cylinder 36 opposite to that mounting the first coupling 45. The second coupling has a substantially cylindrical interior surface 66 of predetermined diameter bounding a discharge passage or opening 67 for the housing 35. The coupling has an externally screw-threaded portion 68 extending thereabout and a flange 69 radially extending from the coupling in juxtaposition to the screw-threaded portion 68. The second coupling is mounted on the cylinder with the screw-threaded portion 68 thereof screw-threadably secured on the end portion 37 of the cylinder with the end portion in abutted engagement with the flange 69, as shown in FIGS. 3 and 4. The coupling has an interior end or seat 70 which extends to a predetermined position within the chamber 39 of the cylinder and circumscribes the discharge opening within the chamber. A guide or key 71 is affixed on the interior surface 66 of the second coupling in a predetermined position.

The tool 10 has a second component or valve member 75 which has a fluid regulating portion 76 and an opposite coupling portion 77. The valve member has an internal passage 78 extending therethrough and communicating externally of the member through opposite externally screw-threaded end portions 79. The valve member has a key way 80 extending longitudinally thereof adjacent to the fluid regulating portion. The valve member is mounted within the housing or first component 35 with the fluid regulating portion 76 thereof received for reciprocal movement within the chamber 39 of the housing and the key 71 received in the key way 80 to prevent rotation of the first and second components relative to each other.

The fluid regulating portion 76 of the valve member 75 mounts a first sealing member 85 extending thereabout in juxtaposition to the external screw-threaded portion 79 thereof. The first sealing member is composed of a flange 86 extending radially from the valve member in spaced relation to the end portion 79. A plurality of seals 87 are extended about the fluid regulating portion of the valve member arranged in stacked relation to engage the flange of the first sealing member, as shown best in FIG. 3. The seals are of a diameter sufficient to engage in fluid sealing relation the internal surface 38 of the cylinder 36 of the housing 35 while permitting longitudinal movement of the fluid regulating portion within the chamber 39 of the cylinder. The seals are preferably constructed of a heat resistant material such as reinforced asbestos. The seals are retained in position against the flange 86 by a washer 88 and lock coupling 89 received on the screw-threaded end portion 79 thereof. The lock coupling is screw-threadably secured on the end portion 79, as best shown in FIG. 3. The lock coupling has a passage 90 communicating with the internal passage 78 of the valve member. The lock coupling has a beveled strike surface 91 circumscribing the passage thereof, facing the beveled shoulder 50 of the first coupling 45 and adapted for facing engagement therewith for purposes subsequently to be described. A second sealing member or flange 92 is mounted on and extends radially from the fluid regulating portion of the valve member in predetermined spaced relation to the first sealing member on the opposite side thereof from the coupling 89.

OPERATION

The operation of the described embodiment of the subject invention is believed to be clearly apparent and is briefly summarized at this point. The tool 10 of the present invention is mounted on the conduit 20 in substantially axial alignment therewith so as to form, in effect, a portion of the conduit. The first component or housing 35 is secured on the conduit by connection of the first coupling 45 to an adjacent conduit section 21 in endward alignment therewith, as shown in FIGS. 2 and 3. Similarly, the coupling portion 77 of the second component or valve member 75 can be connected to an adjacent conduit section in endward alignment therewith utilizing the screw-threaded end portion 79. Alternatively, the coupling portion 77 can be directly connected to the submersible pump 26. Normally, however, the coupling portion is indirectly connected to the pump by way of one or a plurality of endwardly interconnected conduit sections 21. A representative configuration involves the tool being mounted on the conduit 30 to 90 feet above the submersible pump. The precise portion of the tool with respect to the pump, however, is determined by the preferences of the operator and the demands of the specific job for which the tool is employed and does not affect the operation of the tool as herein described.

The push rod 25 is extended through the conduit 20, the housing 35 and valve member 75 of the tool 10, as shown in FIG. 3, and connected to the submersible pump 26. As heretofore described, reciprocation of the push rod operates the pump in the conventional manner to pump fluid through the conduit to the well head 19 at the earth's surface 12 for subsequent handling.

Where such pumping is to proceed as described, the tool 10 is adjusted to the configuration shown in FIG. 3. This is accomplished by raising the conduit 20, using the well rig 18, to position the second sealing member or flange 92 of the second component 75 in a retracted position in fluid-tight sealing engagement with the interior end portion or seat 70 of the second coupling, as shown in FIG. 3. During such positioning, the push rod and pump are left in position thereby providing the movement of the first and second components relative to each other. In this configuration, fluid pumped through the conduit to the well head passes through the internal passage 78 of the valve member 75, into the first passage 39 of the housing 35 and subsequently up the conduit 20 through the passage 46 of the first coupling 45 of the housing. Thus, it will be seen that normal operation of the pump is not impaired by mounting of the tool 10 on the conduit as described.

Frequently, other types of well tools are mounted on conduit employed in a well for the performance of a variety of well operations. Some such tools are designed to be operated by predetermined rotation of the conduit, or by predetermined endward movement of the conduit. Where such tools are mounted on the conduit 20 below the tool 10 of the present invention the key 71 engaged in the key way 80 insures that rotational movement can be transmitted through the tool 10 to the tools mounted on the conduit therebelow. Downward movement can similarly be transmitted through the tool by engagement of the strike surface 91 of the lock coupling 89 with the beveled shoulder 50 of the first coupling 45.

When it is desired to raise the conduit 20 for any of the variety of reasons previously set forth, the hydrostatic head of pressure within the conduit can be discharged in the volume desired through use of the tool 10. This operation is normally accomplished by lowering the conduit, using the well rig 18, to position the housing 35 of the tool 10 in the discharge position shown in FIG. 4 relative to the valve member 75. This is done while the push rod and pump are retained in position. Alternatively, such movement can be imparted to the housing and valve member by pulling upward on the push rod, using the well rig, to raise the pump, conduit and valve member. This can, of course, only be accomplished where the push rod and pump possess sufficient strength to accommodate the weight supported thereon. Still another way of providing such relative movement is by lowering the conduit, pushrod and pump downwardly in the well until the pump engages the bottom of the borehole and the conduit is lowered the predetermined distance further to dispose the housing and valve member in the discharge position. Since in the preferred configuration the tool 10 is 30 to 90 feet above the pump sufficient area exists in the casing to accommodate a large volume of fluid discharged from the conduit through the tool. The exact distance to be traveled in such relative movement is, of course, known by virtue of the known distance of travel of the housing and valve member relative to each other between the retracted configuration shown in FIG. 3 and the discharge configuration shown in FIG. 4.

When positioned as described in the discharge position, the first sealing member 85 is disposed between the first and second ports 40 and 41 respectively and the second sealing member 92 is spaced from the interior end portion or seat 70 of the second coupling 65. Thus, a path of fluid travel is established from the chamber 39 of the housing 35 above the valve member, through the first ports 40, into the annular second passage 57 of the enclosure 55, outwardly from the second passage through the second ports 41 and back into the first passage of the housing 35 below the first sealing member and subsequently from the tool and conduit through the discharge passage or opening 67 of the second coupling between the interior surface 66 thereof and the valve member 75. The push rod 25 is not operated during this discharge operation so as not to operate the pump. This insures that the hydrostatic pressure within the internal passage 78 of the valve member itself and the conduit between the valve member and the pump prevents the fluid in the conduit above the tool from flowing into the internal passage 78 of the valve member.

The discharge configuration shown in FIG. 4 can be maintained as long as desired to discharge the desired amount of fluid from the conduit as required by the operation to be performed. When sufficient fluid has been discharged, the conduit is then again simply raised, using the well rig, for the purposes required. It will be seen that raising of the conduit will similarly raise the housing 35 relative to the valve member thereby again positioning the second sealing member 92 in engagement with the interior end portion or seat 70 of the second coupling 65 thereby terminating the flow of fluid from the conduit through the discharge passage or opening 67 of the second coupling. Thus, the pump can again be operated by the push rod 25 when desired.

An additional important feature of the tool 10 of the present invention provides assistance where the pump 26 must be repositioned within the casing 14 but has become lodged in position, such as by the sand 27. Raising of the pump relative to the casing can normally be accomplished, of course, by simply pulling upwardly on the conduit 20 which transmits such vertical movement to the pump through engagement of the second coupling and the second sealing member 92. Where this is not successful in freeing the pump, the conduit can be rapidly lowered, using the well rig 18, causing the beveled shoulder 50 of the first coupling 45 of the housing 35 to impact with the strike surface 91 of the lock coupling 89 of the valve member 75 thereby transmitting the impact through the tool to the pump which is often helpful in freeing the pump. The engagement of the key 71 in the key way 80 insures that movement of the housing and valve member relative to each other is accomplished smoothly without jamming and that rotation of the conduit can be transmitted through the tool 10 where required, as previously described.

Thus, the tool of the present invention can expeditiously be operated as described by simple endward movement of the conduit 20 and pump 26 relative to each other. No intricate manipulations of the conduit and pump are required and the tool does not need to be locked in engagement with he casing 14 to be operated. Furthermore, no intricate moving parts or seals are employed thereby insuring a long operational life without repair. Thus, the tool does not need to be frequently withdrawn from the well for the replacement of worn parts as is required by conventional tools. The use of seals 87 which are constructed of reinforced asbestos allows the tool to be employed in steam injection oil wells and at great depth without the seal failure associated with prior art devices.

Therefore, the tool of the present invention permits the control of the flow of fluid through and the periodic discharge of fluid from a conduit at a remote location and has particular utility in wells by permitting hydrostatic pressure within a well conduit to be discharged from the conduit and into the well whenever desired and under conditions of extreme temperature without requiring frequent servicing and repair and which does not interfere with the normal operation of the pump, conduit and associated equipment of the well.

Although the invention has been herein shown and described in what is conceived to be the most practical and preferred embodiment, it is recognized that departures may be made therefrom within the scope of the invention, which is not to be limited to the illustrative details disclosed.

Having described our invention, what we claim as new and desire to secure by Letters Patent is:

1. A tool for controlling the flow of fluid through a conduit at a remote location, the tool comprising a valve assembly having first and second components interconnected for movement relative to each other wherein the first component has a coupling at one end thereof for connection in fluid transferring relation to the conduit, the components having first passages extending therethrough to establish fluid communication within the conduit through the valve assembly and the first component having an opposite end with an opening for discharge of fluid from the valve assembly with the second component received for reciprocal movement within the first component extending through said discharge opening and said first component having a second passage by-passing a portion of the first passage of the first component and communicating with said discharge opening when said components are disposed in predetermined positions relative to each other; sealing means mounted on the second component for movement with said second component between a retracted position in which said sealing means seals the discharge opening of the first component and a discharge position in which said sealing means directs fluid through the second passage and opens the discharge opening; and an enclosure mounted on the first component through which the second passage extends communicating with the first passage of the first component through a pair of spaced openings and the discharge position of the second component positions the sealing means between said spaced openings whereby fluid is directed from the first passage of the first component into the second passage circumventing the sealing means and back into the first passage of the first component for discharge from the valve assembly through the discharge opening.

2. The tool of claim 1 wherein the first and second components are mounted on the conduit in substantially axial alignment therewith in a well, said conduit mounts a fluid pump below the first and second components which is operated by a push rod extending down the conduit and operably connected to the pump and the second component is secured on the conduit in fixed relation to the pump and is positionable in said retracted and discharge positions by endward displacement of the conduit connected to the first component and push rod relative to each other.

3. A tool for controlling the flow of fluids through conduit at remote locations, the tool comprising a housing adapted for connection to the conduit at a remote location and having a first passage extending therethrough and communicating with a discharge opening and a second passage extending through said housing circumventing a portion of said first passage in a by-pass position, the second passage of the housing communicating with the first passage thereof through a pair of spaced openings and the housing having a valve seat which bounds the discharge opening; and valve means adapted for connection to said conduit and received within the first passage for movement relative to the housing between a retracted position and said by-pass position and the valve means having an internal passage interconnecting the interior of the housing and the conduit and said valve means mounting a seal thereabout which contacts the housing in fluid sealing relation between said spaced openings when the valve means is in the by-pass position and in said retracted position engages said valve seat of the housing in fluid sealing relation to direct fluid passing through the conduit through the first passage of the housing and the internal passage of the valve means.

4. The tool of claim 3 wherein the conduit is composed of a plurality of interconnected conduit sections and the housing and valve means are of substantially cylindrical construction mounted on the conduit so as to interconnect a pair of said conduit sections in substantially axial alignment therewith and dimensioned to provide substantially unimpeded fluid in the conduit through the tool when the valve means is in the retracted position.

5. The tool of claim 4 wherein the conduit is located in a well and mounts a pump thereon below the valve means operated by a push rod connected to the pump and extending upwardly through the conduit through the valve means and housing and said relative movement of the valve means and housing is accomplished by maintaining one of the push rod and conduit stationary and moving the other thereof longitudinally of the well away from said one.

6. The tool of claim 5 wherein the housing has an internal shoulder and the valve member has a strike surface facing the shoulder whereby the conduit above the housing can be lowered rapidly to cause the shoulder to impact on the strike surface to transmit a force through the valve means and conduit below the valve means to assist in freeing the pump when it becomes lodged in the well.

7. The tool of claim 6 wherein said relative movement of the housing and valve means is guided by a key and key way interconnecting the housing and valve means and permitting rotational movement applied to the conduit above the housing to be transmitted to the conduit below the valve means.

8. The tool of claim 7 wherein the seal mounted on and extending about the valve means is constructed of a material resistant to high temperatures and a flange extends about the valve means below the seal for said fluid sealing engagement with the valve seat of the housing in the retracted position.

9. A tool for discharging hydrostatic pressure from a conduit within a well and having a remote end mounting a pump operable, upon reciprocation of a rod extending through the conduit and connected to the pump, to pump fluid from the well through the conduit, the tool comprising a substantially cylindrical housing having a proximal end and an opposite distal end interconnected by a substantially cylindrical internal passage and having first and second ports extending through the housing in predetermined spaced relation communicating with the internal passage thereof; a first coupling borne by the proximal end of the housing having an end portion adapted for mounting on a portion of said conduit in endwardly aligned fluid communication; a second coupling mounted on and extending into the distal end of the housing having an interior end circumscribing a passage of predetermined transverse dimensions; an enclosure extending about the housing in covering relation to the first and second ports to form a fluid-tight passage interconnecting said ports; a valve member having a fluid regulating portion extending through the passage of the second coupling and received for reciprocal movement within the internal passage of the housing, an opposite end adapted for mounting on a second portion of said conduit which mounts the pump and having an internal passage extending therethrough for interconnection of the pump and internal passage of the housing in fluid transferring relation and said valve member being reciprocal within the housing between predetermined fluid transfer and fluid discharge positions upon movement of the portion of the conduit mounting the housing and the pump by the push rod relative to each other; a first seal extending about said regulating portion for sealing engagement with the interior end of the second coupling to seal the passage thereof when the valve member is in the fluid transfer position to direct fluid transferred along the conduit through the tool; and a second seal extending about the fluid regulating portion of the valve member in engagement with the housing for movement with the valve member to the discharge position between said first and second ports to direct fluid transferred along the conduit through said ports and the passage of the enclosure and from the tool externally of the conduit through the passage of the second coupling.

10. A tool for controlling the flow of fluid through a conduit at a remote location, the tool comprising a valve assembly having first and second components adapted for mounting on said conduit for positioning at the remote location and interconnected for movement relative to each other between predetermined retracted and by-pass positions, the components having first passages extending therethrough to establish fluid communication within the conduit through the valve assembly and a second passage communicating with the first passage thereof through a pair of spaced openings bypassing a portion of the first passage of the first component in the by-pass portion; and a seal mounted on the second component which contacts the first component in fluid sealing relation between said spaced openings when the components are in said by-pass position.

11. The tool of claim 10 wherein the conduit is positioned in a well and mounts a pump thereon below the valve assembly operated by a push rod connected to the pump and extending upwardly through the conduit and valve assembly and said relative movement of the first and second components of the valve assembly is performed by maintaining one of said push rod and conduit above the valve assembly stationary and moving the other thereof longitudinally of the well.

12. The tool of claim 10 wherein the first and second components individually have an internal shoulder and a strike surface and the portion of said conduit in connection with the first component can be rapidly motivated in the direction of the portion of said conduit in connection with the second component to cause the shoulder and strike surface rapidly to engage each other and thereby transmit a force through the valve assembly to the portion of the conduit on which the second component is mounted.

13. The tool of claim 10 wherein the first and second components are interconnected by a key and a key way permitting longitudinal movement of the components relative to each other and permitting rotational movement of one of said components to be transferred to the other of said components.

14. The tool of claim 13 wherein the first component has an internal shoulder and the second component has a strike surface facing the shoulder whereby the portion of the conduit on which the first component is mounted can be motivated rapidly toward the second component to cause the shoulder to impact on the strike surface to transmit a force through the tool to the portion of the conduit on which the second component is mounted.

15. The tool of claim 14 wherein the conduit is positioned in a well and mounts a pump thereon below the valve assembly operated by a push rod connected to the pump and extending upwardly through the conduit, through the second component and through the first component and said relative movement of the first and second components is performed by maintaining one of said push rod and conduit above the valve assembly stationary and moving the other thereof longitudinally of the well.

16. The tool of claim 15 wherein the seal mounted on and extending about the second component is constructed of a material resistant to high temperatures.

* * * * *

UNITED STATES PATENT AND TRADEMARK OFFICE

CERTIFICATE OF CORRECTION

PATENT NO. : 3,995,691

DATED : December 7, 1976

INVENTOR(S) : Floyd R. Hedgecock and Andrew J. Trent

It is certified that error appears in the above–identified patent and that said Letters Patent are hereby corrected as shown below:

Column 4, Line 15 delete "the" and insert --- The ---.

Column 5, Line 39, delete "portion" and insert --- position ---.

Column 7, Line 41, delete "he" and insert --- the ---.

Column 9, Line 9, after "fluid" and before "in" insert --- flow ---.

Column 10, Line 31, delete "portion" and insert --- position ---.

Signed and Sealed this

Fifteenth Day of March 1977

[SEAL]

*Attest:*

RUTH C. MASON
*Attesting Officer*

C. MARSHALL DANN
*Commissioner of Patents and Trademarks*